US009914517B2

(12) United States Patent
Shomura et al.

(10) Patent No.: US 9,914,517 B2
(45) Date of Patent: Mar. 13, 2018

(54) MOUNTING DEVICE FOR OUTBOARD MOTOR

(71) Applicant: SUZUKI MOTOR CORPORATION, Hamamatsu-Shi, Shizuoka (JP)

(72) Inventors: Nobuyuki Shomura, Hamamatsu (JP); Seiji Uehara, Hamamatsu (JP); Sho Ishizaki, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 15/402,587

(22) Filed: Jan. 10, 2017

(65) Prior Publication Data

US 2017/0210454 A1 Jul. 27, 2017

(30) Foreign Application Priority Data

Jan. 22, 2016 (JP) ..... 2016-010877

(51) Int. Cl.

| | |
|---|---|
| ***B63H 1/15*** | (2006.01) |
| ***B63H 21/30*** | (2006.01) |
| ***B63H 20/06*** | (2006.01) |
| ***B63H 20/10*** | (2006.01) |
| ***B63H 20/12*** | (2006.01) |
| ***B63H 20/32*** | (2006.01) |
| ***B63H 21/32*** | (2006.01) |
| ***B63H 25/02*** | (2006.01) |

(52) U.S. Cl.

CPC ..... *B63H 20/06* (2013.01); *B63H 20/10* (2013.01); *B63H 20/12* (2013.01); *B63H 20/32* (2013.01); *B63H 21/32* (2013.01); *B63H 25/02* (2013.01); *B63H 2025/024* (2013.01)

(58) Field of Classification Search

CPC ..... B63H 20/00; B63H 20/02; B63H 20/06; B63H 20/10; B63H 20/12; B63H 20/14; B63H 20/32; B63H 25/02; B63H 2020/00; B63H 2020/02; B63H 2020/08; B63H 2020/10; B63H 2020/103; B63H 2020/14; B63H 2020/32; B63H 2025/024

USPC ..... 440/53, 55, 57, 61 S, 61 T, 61 F, 62, 63, 440/64, 76, 77, 83, 52

See application file for complete search history.

(56) References Cited

U.S. PATENT DOCUMENTS

| | | | | |
|---|---|---|---|---|
| 3,127,866 A * | 4/1964 | Mohr | B63H 20/14 | 440/52 |
| 4,507,090 A * | 3/1985 | Kobayashi | B63H 20/08 | 248/640 |
| 5,219,306 A * | 6/1993 | Takahashi | B63H 21/305 | 248/640 |
| 5,443,406 A * | 8/1995 | Mondek | B63H 20/12 | 248/640 |

(Continued)

FOREIGN PATENT DOCUMENTS

| | | |
|---|---|---|
| JP | H11189199 A | 7/1999 |
| JP | 2002347696 A | 12/2002 |

*Primary Examiner* — Daniel V Venne

(74) *Attorney, Agent, or Firm* — Troutman Sanders LLP

(57) ABSTRACT

In an upper mount portion, a steering central axis related to a steering force of a steering handle and a vibration central axis related to a torque reaction force of an engine are configured to be shifted back and forth. A mount member is formed such that a spring constant related to the vibration central axis is smaller than a spring constant related to the steering central axis.

9 Claims, 9 Drawing Sheets

(56) References Cited

U.S. PATENT DOCUMENTS

| | | | | | |
|---|---|---|---|---|---|
| 5,511,997 | A * | 4/1996 | Yoshida | B63H 20/12 | 248/635 |
| 5,755,603 | A * | 5/1998 | Kumita | B63H 20/10 | 440/55 |
| 5,799,925 | A * | 9/1998 | Kumita | B63H 20/10 | 248/642 |
| 5,846,106 | A * | 12/1998 | Kumita | B63H 20/02 | 248/635 |
| 6,149,475 | A | 11/2000 | Tasaka et al. | | |
| 6,280,268 | B1 * | 8/2001 | Nishi | B63H 20/10 | 440/61 D |
| 6,419,534 | B1 * | 7/2002 | Helsel | B63H 20/02 | 440/52 |
| 2006/0240722 | A1 * | 10/2006 | Kubinski | B63H 20/10 | 440/61 T |

* cited by examiner

MOUNTING DEVICE FOR OUTBOARD MOTOR

CROSS-REFERENCE TO RELATED APPLICATIONS

This application is based upon and claims the benefit of priority of the prior Japanese Patent Application No. 2016-010877, filed on Jan. 22, 2016, the entire contents of which are incorporated herein by reference.

FIELD OF THE INVENTION

The present invention relates to a mounting device that supports an outboard motor body with a swivel bracket in an outboard motor mounted to a ship via this swivel bracket.

BACKGROUND

Usually, an outboard motor is mounted to a transom of a ship via a swivel bracket. In this case, the outboard motor is rotatably mounted to the swivel bracket. For example, a steering handle with a throttle grip to adjust engine output at a distal end typically extends from a front lower portion of an engine forward. Horizontally steering this steering handle changes a direction of the entire outboard motor, thus ensuring the steering of a ship.

There has been provided a mounting structure for an outboard motor, for example, like the following outboard motor according to Patent Document 1. A drive shaft housing, which includes a drive shaft in an internal exhaust passage, is disposed below an engine. The drive shaft housing is rotatable supported to a rotating support portion of a swivel bracket. A resilient body is mounted to an outer peripheral surface of the drive shaft housing. A handle bracket to support a base of the steering handle is mounted to an outer peripheral surface of this resilient body. A bracket cover to which the swivel bracket is mounted is slidably mounted to an outer peripheral surface of the handle bracket via a bush. This mounting structure reduces a transmission of engine vibrations to the steering handle side and a ship side by the resilient body.

An outboard motor according to Patent Document 2 includes a resilient member interposed between a steering handle and an engine side. This resilient member is configured to be freely vibratable in a clearance between the steering handle and the engine side. The outboard motor further includes an abutting portion, which can be brought into abutment with the engine side, on a steering handle side. This mounting structure minimizes vibrations transmitted from the engine to the steering handle.

Patent Document 1: Japanese Laid-open Patent Publication No. 2002-347696

Patent Document 2: Japanese Laid-open Patent Publication No. 11-189199

Conventionally, as described above, a steering function and a vibration damping function are obtained by a mount shape, approximately cylindrical shape, of the resilient body or the resilient member. In this case, a spring constant in a rotation direction of the resilient body is generally preferable to be large in terms of the steering function. In terms of the vibration damping function, the spring constant is generally preferable to be small. Reducing the spring constant of the mount (resilient body) to reduce vibrations causes a problem of making responsiveness or operational feeling of the steering worse. Thus, a balance between the functions conflicting in the approximately cylindrical mount shape needs to be considered. Therefore, achieving further improvement both in the vibration damping function and the steering performance is not easy.

SUMMARY OF THE INVENTION

The present invention has been made to solve such circumstances, and an object of the present invention is to provide a mounting device for outboard motor that ensures effectively improving the vibration damping function and the steering performance with simple configuration.

A mounting device for outboard motor according to the present invention includes an engine, a drive shaft housing, and a swivel bracket. The engine includes a crankshaft in a vertical direction. A cylinder axis line of the engine extends rearward in a ship advancing direction. The drive shaft housing internally includes a longitudinally-oriented drive shaft. The drive shaft is coupled to the crankshaft at a lower side of the engine. The swivel bracket rotatably supports a tubular outer peripheral portion of the drive shaft housing by upper and lower mount portions. A mount member is fitted to at least the upper mount portion. The mount member is formed of a resilient body and rotates integrally with the outer peripheral portion of the drive shaft housing. A handle bracket is fitted onto an outer periphery of the mount member. The handle bracket supports a steering handle. The steering handle can be rotated with respect to the upper mount portion. In the upper mount portion, a steering central axis for a steering force of the steering handle and a vibration central axis for a torque reaction force of the engine are configured to be shifted back and forth. The mount member is formed such that a spring constant for the vibration central axis is smaller than a spring constant for the steering central axis.

The mounting device for outboard motor according to the present invention is configured as follows. The mount member forms an approximately cross-shaped steering force transmission portion with front, rear, right, and left protrusions to form an inner peripheral surface of the handle bracket into a shape approximately similar to the mount member. Right and left protrusions, with a shape approximately similar to the mount member, are formed on an outer peripheral surface of the drive shaft housing. The mount member is configured to have the steering central axis at a cross-shaped intersection portion.

The mounting device for outboard motor according to the present invention is configured as follows. Clearances are disposed between the respective right and left protrusions and the inner peripheral surface of the handle bracket or the outer peripheral surface of the drive shaft housing.

The mounting device for outboard motor according to the present invention is configured as follows. A curvature radius of an outer peripheral surface of the rear protrusion of the mount member is configured smaller than a curvature radius of the inner peripheral surface of the handle bracket.

The mounting device for outboard motor according to the present invention further includes protrusions. The protrusions project from the drive shaft housing outside at an inside of the rear, right and left protrusions of the mount member. The rear, right and left protrusions are configured to have radial thicknesses thinner than a radial thickness of the front protrusion of the mount member.

DETAILED DESCRIPTION OF THE PREFERRED EMBODIMENTS

The following describes preferred embodiments of a mounting device for outboard motor according to the present invention with reference to the drawings.

Figure 1:
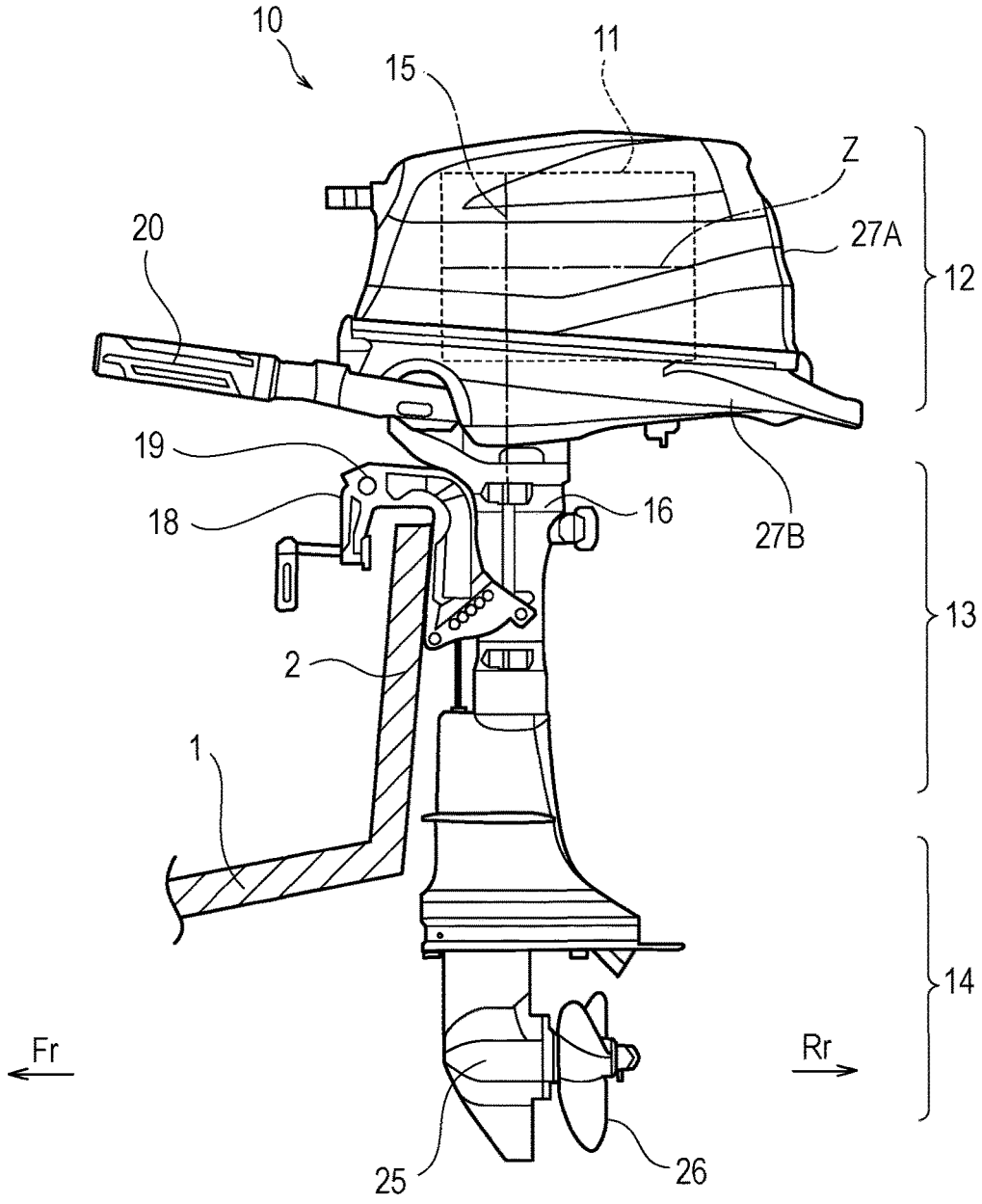
FIG. 1 is a side view illustrating an overall configuration of an outboard motor according to the present invention.
Figure 2:
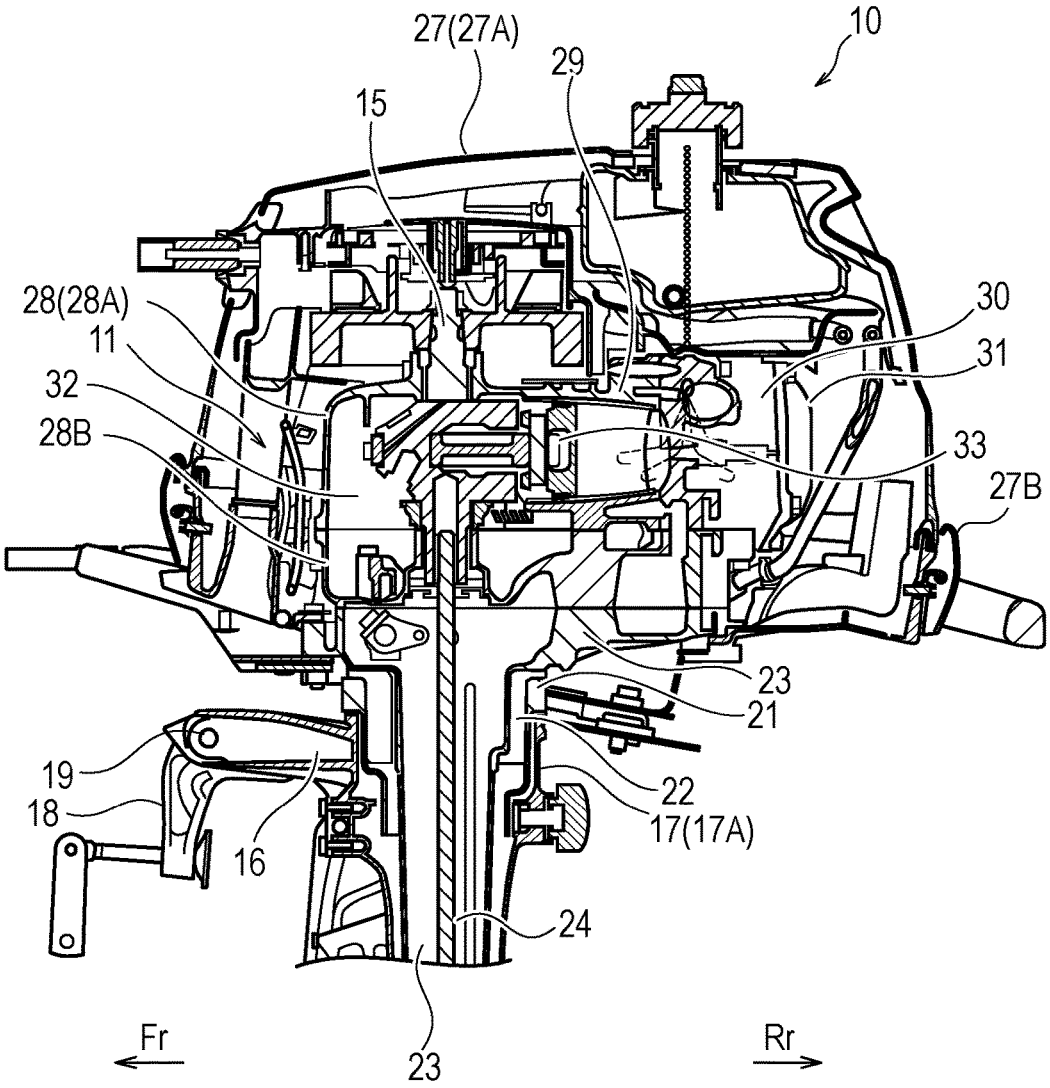
FIG. 2 is a cross-sectional view illustrating an internal structure of the outboard motor according to an embodiment of the present invention.

FIG. 1 is a left side view illustrating an exemplary schematic configuration of an outboard motor 10 as an application example of the present invention. FIG. 2 is a cross-sectional view illustrating inside the outboard motor 10. In this example, as illustrated in the drawings, the outboard motor 10 is secured to a rear plate 2 of a ship 1 on a front portion side of the outboard motor 10. The outboard motor 10 includes an engine 11. In the following description, in each drawing, an arrow Fr and an arrow Rr indicate forward and rearward of the outboard motor 10 or the engine 11, and an arrow R and an arrow L indicate the right side and the left side of the side portions of the outboard motor 10, respectively, as necessary.

Referring to FIG. 1 and FIG. 2, in the overall configuration of the outboard motor 10, an upper unit (or a power unit) 12, a middle unit 13, and a lower unit 14 are located from an upper portion to a lower portion in the order. The outboard motor 10 includes the engine 11 in the upper unit 12 to longitudinally include and support the engine 11 such that a crankshaft 15 of the engine 11 faces a vertical direction. For the engine 11, a single cylinder engine is typically applicable. The outboard motor body including the upper unit 12, the middle unit 13, and the lower unit 14 is rotatably supported horizontally by upper and lower rotation support portions (an upper rotation support portion 17A is illustrated in FIG. 2) disposed at a swivel bracket 16. A specific configuration of this rotation support portion 17 will be described later. The swivel bracket 16 includes a pair of clamp brackets 18 (stern brackets) on both right and left sides thereof, and both clamp brackets 18 are coupled to one another via a tilt shaft 19 configured in a lateral direction. The clamp brackets 18 are secured to the rear plate 2, which is positioned at a rear end of the ship 1, and the entire outboard motor 10 is supported rotatably in the vertical direction around the tilt shaft 19 via the swivel bracket 16.

Figure 3:
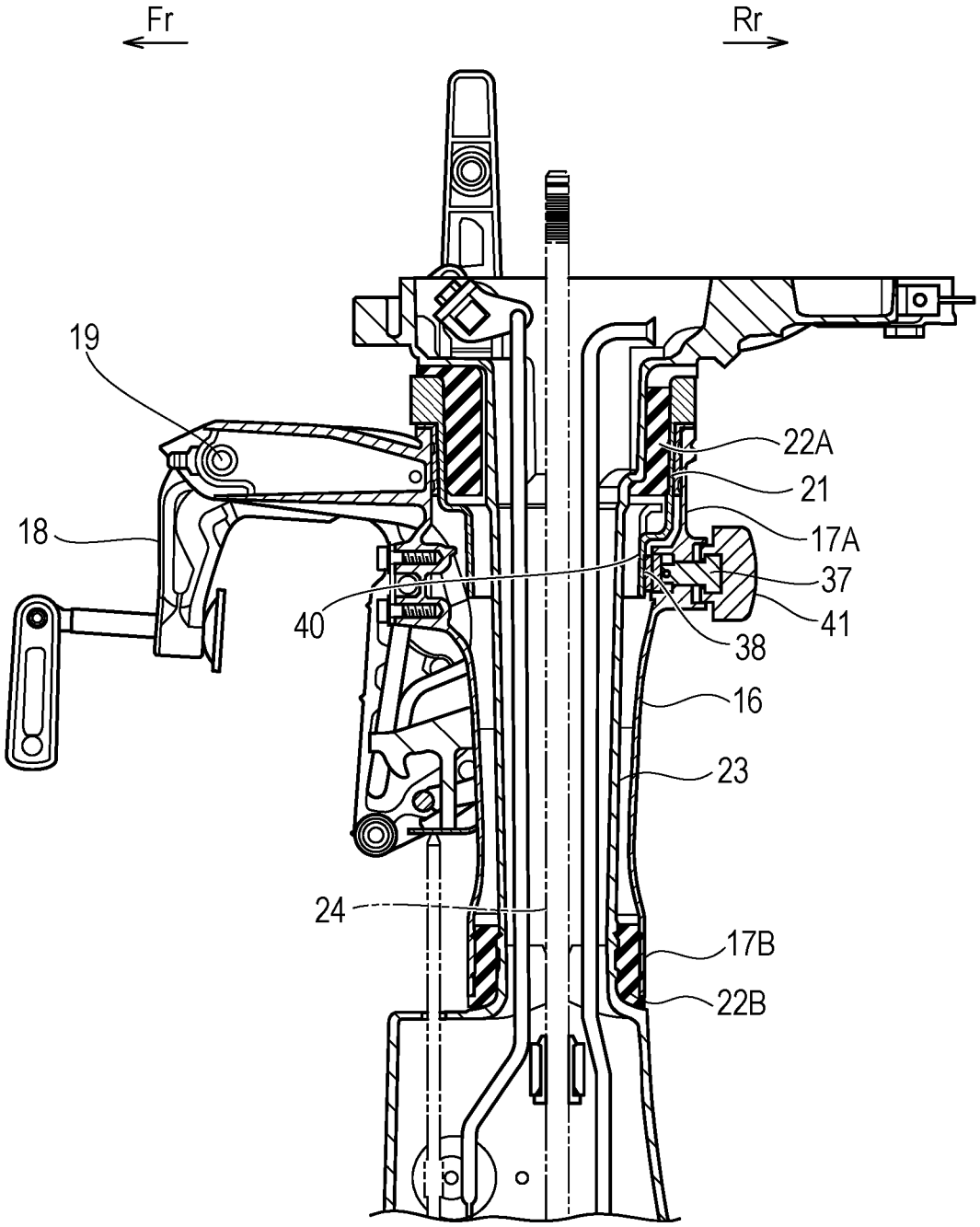
FIG. 3 is a cross-sectional view illustrating an internal structure around a middle unit according to the embodiment of the present invention.

Referring to FIG. 3, in a supporting structure of the outboard motor body, the swivel bracket 16 includes the upper rotation support portion 17A and a lower rotation support portion 17B. To the upper rotation support portion 17A of the swivel bracket 16, a handle bracket 21 to which a tiller handle 20 (FIG. 1) is joined together is rotatably mounted. The handle bracket 21 is formed into a cylindrical shape on the whole. The handle bracket 21 is configured to support a base of the tiller handle 20 and correspond to the rotation support portion 17A. A mount 22A (mount member), which is formed of a resilient body, is inserted inside the handle bracket 21. A drive shaft housing 23 is fitted to further inside this mount 22A. The drive shaft housing 23 internally forms an exhaust passage through which exhaust gas from the engine 11 flows. The handle bracket 21 and the drive shaft housing 23 are joined to integrally rotate via the mount 22A. The drive shaft housing 23 is rotatably supported at the rotation support portion 17A via the handle bracket 21 and the mount 22A. The engine 11 is mounted and supported on the drive shaft housing 23. A turning operation of the tiller handle 20 allows the entire power unit including the drive shaft housing 23 to horizontally turn on the rotation support portion 17A. The mount 22A is interposed between the handle bracket 21, which joins to the tiller handle 20 together, and the drive shaft housing 23 to which the engine 11 is mounted. This configures a structure to reduce a transmission of vibrations from the engine 11 to the tiller handle 20.

The lower rotation support portion 17B is disposed near the lower portion of the middle unit 13 separated by a predetermined distance from the upper rotation support portion 17A downward. The drive shaft housing 23 is rotatably supported horizontally also at this rotation support portion 17B. In this case, a mount 22B, which is formed of a resilient body, is inserted inside a lower end portion of the swivel bracket 16. In this manner, the outboard motor body has the supporting structure that elastically supports the drive shaft housing 23 at the upper and lower end portions of the swivel bracket 16 via the mount 22A and the mount 22B.

The drive shaft housing 23 has a tubular hollow shape on the whole and on which the engine 11 is integrally joined together. A drive shaft 24, which is coupled to a lower end portion of the crankshaft 15, is penetratingly disposed in the vertical direction inside the drive shaft housing 23. A driving force of the drive shaft 24 is transmitted to a propeller shaft in a gear case 25 of the lower unit 14. The propeller shaft includes a propeller 26 on a rear end, and the power of the engine 11 passes through a power transmission path, which is constituted of the crankshaft 15, the drive shaft 24, the propeller shaft, and a similar component, to be finally transmitted to the propeller 26. Then, the propeller 26 can be rotatably driven.

In the above-described case, the upper unit 12 is covered with an exterior cover 27. The exterior cover 27 includes an upper cover 27A, which covers around an upper portion of the upper unit 12, and a lower cover 27B, which covers around a lower portion of the upper unit 12. The upper cover 27A and the lower cover 27B are integrally joined together to form an appearance form such as an approximately egg shape or lemon shape as a whole.

Giving an outline of the engine 11, for example, an Over Head Valve (OHV) engine may be used as the engine 11. As illustrated in FIG. 2, the crankshaft 15 is longitudinally mounted and supported on the drive shaft housing 23 in the upper unit 12 such that the crankshaft 15 faces the vertical direction. The engine 11 is formed by integrally joining a cylinder block 29, a cylinder head 30, and a cylinder head cover 31 together sequentially at the rear of an engine case 28. When the outboard motor 10 is equipped to the ship 1 as illustrated in FIG. 1, a cylinder axis line Z typically orients rearward in a horizontal direction perpendicular to the vertical direction.

The engine case 28 is divided into an upper engine case 28A and a lower engine case 28B each of which integrally includes the cylinder block 29. Although detailed illustration and a similar description will be omitted, as illustrated in FIG. 2, the crankshaft 15 is rotatably supported in a crank chamber 32 by bearings disposed in the respective upper engine case 28A and lower engine case 28B. The cylinder block 29 includes a cylinder bore that internally houses a piston 33 reciprocatably along the cylinder axis line direction. The crankshaft 15 and the piston 33 are coupled to one another via a connecting rod. The reciprocation of the piston 33 in the cylinder axis line direction in the cylinder bore of the cylinder block 29 rotatably drives the crankshaft 15 via the connecting rod.

To the engine 11, additionally, an intake system, an exhaust system, a cooling system, a lubricating system, and a control system (Engine Control Unit: ECU) are attached. The intake system supplies air-fuel mixture containing air (intake air) and fuel. The exhaust system discharges burnt exhaust gas in the cylinder from the engine 11. The cooling system cools the engine 11. The lubricating system lubricates movable parts of the engine 11. The control system controls operations of these systems. The control by the control system causes the plurality of functional systems to collaborate with the above-described auxiliary machines and a similar member so as to perform the smooth operation as the entire engine 11.

Appropriately turning the tiller handle 20 in the outboard motor 10 with the above-described configuration rotates the outboard motor body including the engine 11 and the drive shaft housing 23 at the upper rotation support portion 17A and the lower rotation support portion 17B via the handle bracket 21. The turning operation, namely, the steering of the tiller handle 20 horizontally turns the power unit on the rotation support portion 17A and the rotation support portion 17B, allowing the propeller 26 to be steered at a desired angle.

Figure 4:
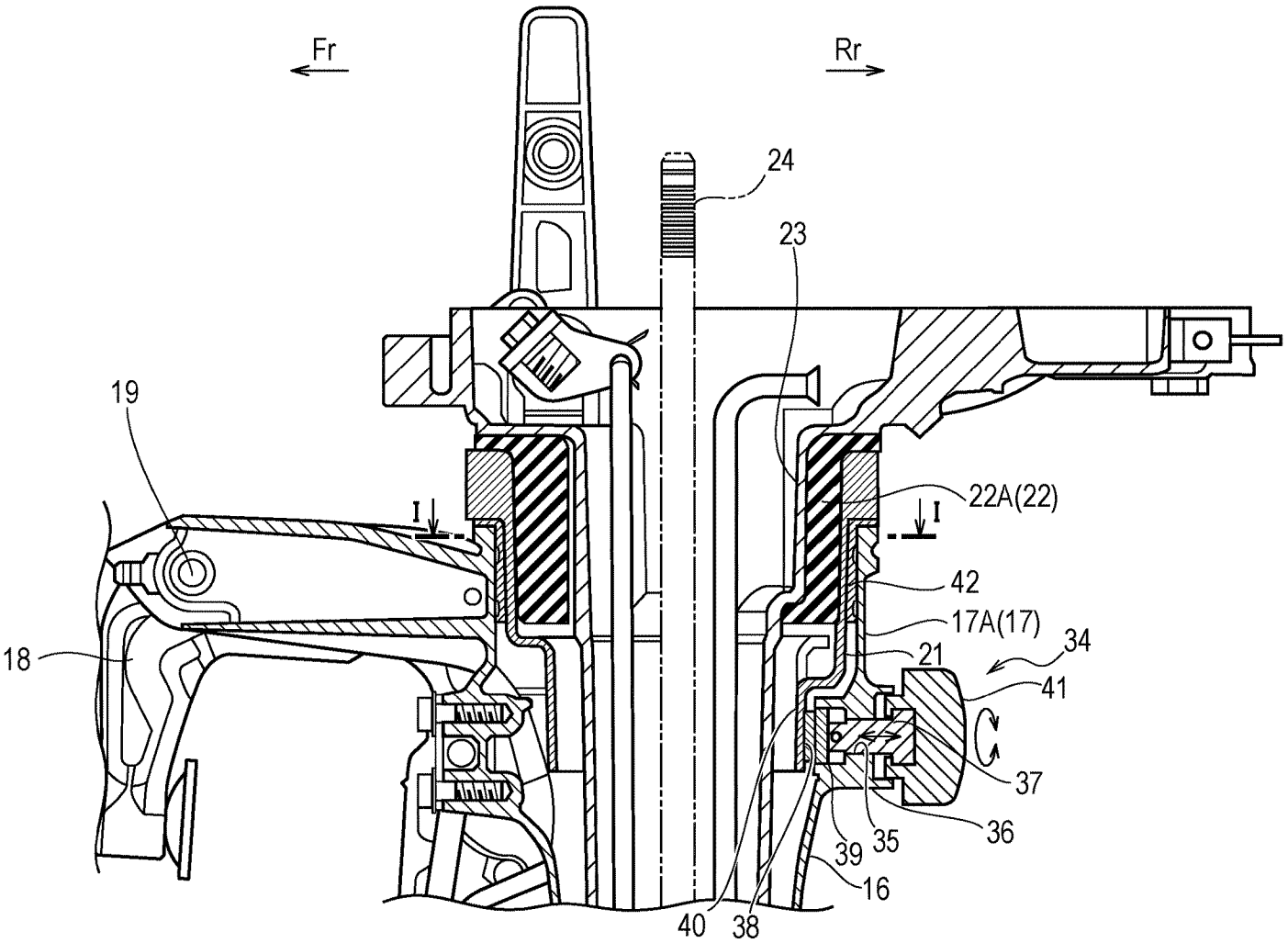
FIG. 4 is a cross-sectional view illustrating an internal structure around a steering force adjusting mechanism according to the embodiment of the present invention.

With the outboard motor 10 of the present invention, the drive shaft housing 23 is supported to be slidably rotatable by the swivel bracket 16. The outboard motor 10 includes a steering force adjusting mechanism that adjusts a steering force to slidably rotate this drive shaft housing 23. FIG. 4 illustrates an exemplary configuration around a steering force adjusting mechanism 34. In the specific configuration of the steering force adjusting mechanism 34, at least the upper rotation support portion 17A includes an adjustment operation portion 36 with a screw hole 35. The swivel bracket 16 passes through the adjustment operation portion 36. To the screw hole 35 on this adjustment operation portion 36, a screw shaft 37 whose distal end is brought into abutment with a pressing member, which will be described later, is joined with screw, namely, screwed. A pressing surface 38 is configured at a position corresponding to the adjustment operation portion 36 on an outer periphery of the handle bracket 21. A pressing member 39 is mounted between the pressing surface 38 and a distal end of the screw shaft 37.

The pressing surface 38 on the handle bracket 21 is formed into a small-diameter shoulder 40 with diameter smaller than a site corresponding to the upper rotation support portion 17A. The small-diameter shoulder 40 is configured by concentrically reducing the diameter of a lower end portion of the handle bracket 21, and an outer peripheral surface thereof is formed as the pressing surface 38. An operation knob 41 is joined to be integrally rotatable with a base end side of the screw shaft 37. Steering this operation knob 41 to the right and left advances and retreats the screw shaft 37 in its axial direction, thus adjusting a magnitude of strength of pressing against the pressing surface 38 by the pressing member 39. In the above-described case, as illustrated in FIG. 4, the swivel bracket 16 and an annular-shaped or short-tubular-shaped bush 42, which is made of resin, of the handle bracket 21 are mounted to the upper rotation support portion 17A. For actual use, a lubricant such as grease or appropriate lubricating oil is loaded to the bush 42.

As described above, the pressing surface 38 is disposed at the small-diameter shoulder 40, which is the lower end portion of the handle bracket 21. In this case, as illustrated in FIG. 3, the pressing surface 38 is disposed extending from the handle bracket 21 downward so as to be located between the upper rotation support portion 17A and the lower rotation support portion 17B.

In the actual use of the outboard motor 10, the turning operation of the tiller handle 20 by a passenger turns the outboard motor body via the upper rotation support portion 17A and the lower rotation support portion 17B, thus allowing the propeller 26 to be steered at the desired angle. Then, the pressing member 39 at the distal end of the screw shaft 37 appropriately pushes and is slidably in contact with the pressing surface 38, thus ensuring obtaining the appropriate steering force of the tiller handle 20. When the outboard motor 10 is thus steered, the drive shaft housing 23, specifically the handle bracket 21 is rotatably supported to be slidable by the swivel bracket 16. The screw shaft 37 is screwed into the screw hole 35 and the pressing member 39 pushes the pressing surface 38 on the handle bracket 21 to increase a friction force at the contact surface. Thus, the steering force to the drive shaft housing 23 at the time is strengthens. That is, the turning operation by the operation knob 41 allows setting the desired steering force.

As described above, the present invention disposes the crankshaft 15 that faces the vertical direction in the engine 11 and orients the rear side in the horizontal direction, a direction of the cylinder axis line Z being perpendicular to the vertical direction. As described above, the mount 22A is fitted to the upper mount portion. The mount 22A is formed of the resilient body and rotates integrally with the outer peripheral portion of the drive shaft housing 23. The handle bracket 21 is fitted onto the outer periphery of this mount 22A. The handle bracket 21 supports the tiller handle 20 (steering handle) turnable with respect to the upper mount portion.

Figure 5:
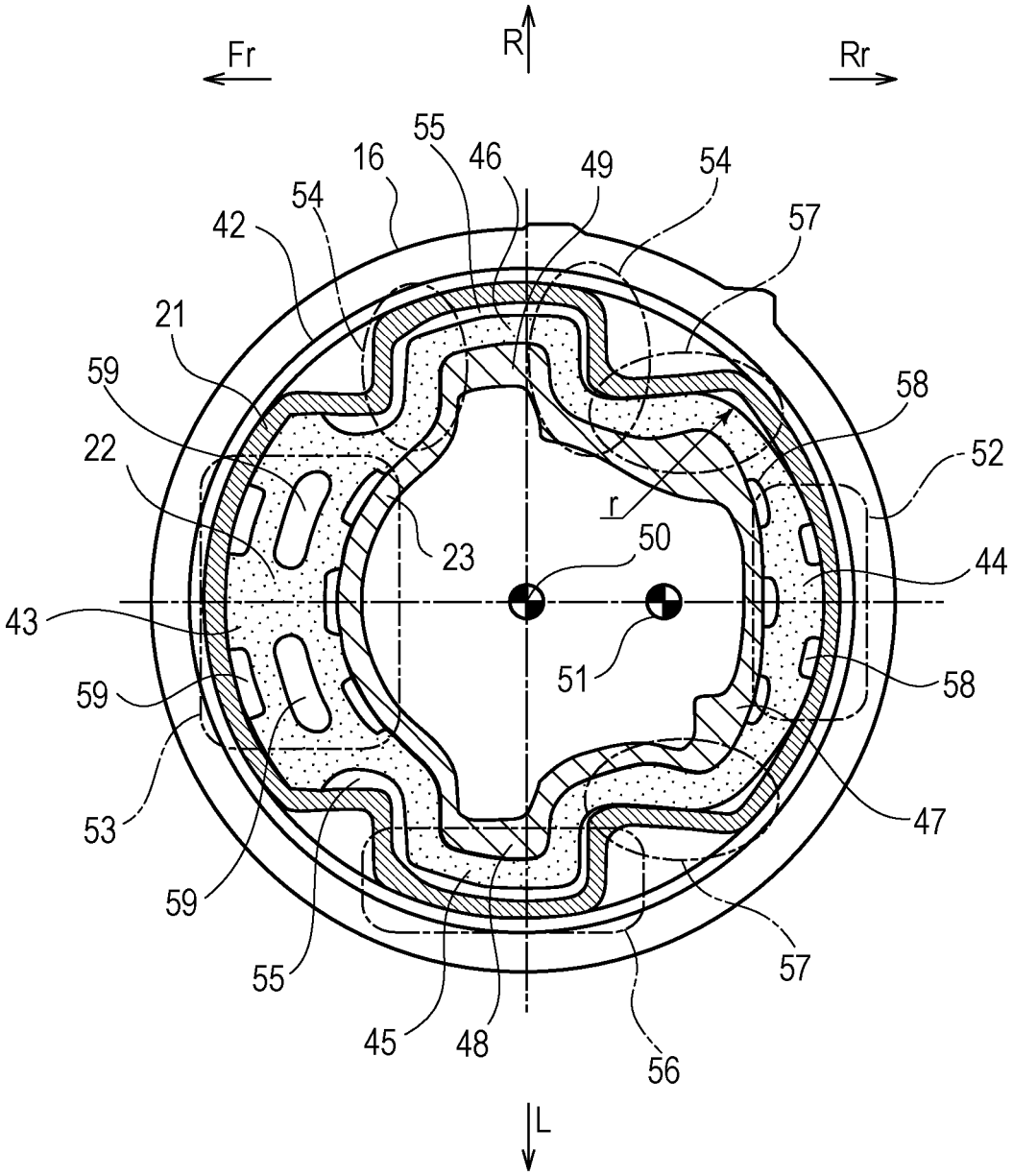
FIG. 5 is a cross-sectional view taken along the line I-I in FIG. 4 illustrating an exemplary configuration of a mount member of a mounting device according to the embodiment of the present invention.

Referring to FIG. 5 for the upper mount portion of the mounting device for outboard motor according to the present invention, a steering central axis 50 for the steering force of the tiller handle 20 and a vibration central axis 51 for a torque reaction force of the engine 11 are configured to be shifted back and forth. The torque reaction force of the engine 11 is a reaction force from a flywheel caused by burning and explosion during idling or comparatively low rotation speed.

The mount 22A (hereinafter simply referred to as a mount 22) is formed such that a spring constant for the vibration central axis 51 is smaller than the spring constant for the steering central axis 50. A specific configuration for the specification will be described later.

As illustrated in FIG. 5, the mount 22 includes front protrusion 43, rear protrusion 44, left protrusion 45, and right protrusion 46 and the front, rear, left, and right protrusions are formed into an approximately cross shape as a whole. On the other hand, the drive shaft housing 23, which is disposed inside the mount 22, includes respectively, a drive shaft rear protrusion 47, a drive shaft left protrusion 48, and a drive shaft right protrusion 49 projecting outside at inside the rear protrusion 44 and the left and right protrusions 45 and 46 of the mount 22. This configures radial thicknesses of the rear protrusion 44 and the left and the right protrusions 45 and 46 of the mount 22 thinner than that of the protrusion 43 at the front.

A curvature radius r of an outer peripheral surface of the rear protrusion 44 of the mount 22 is configured smaller than a curvature radius of an inner peripheral surface of the handle bracket 21.

Figure 6:
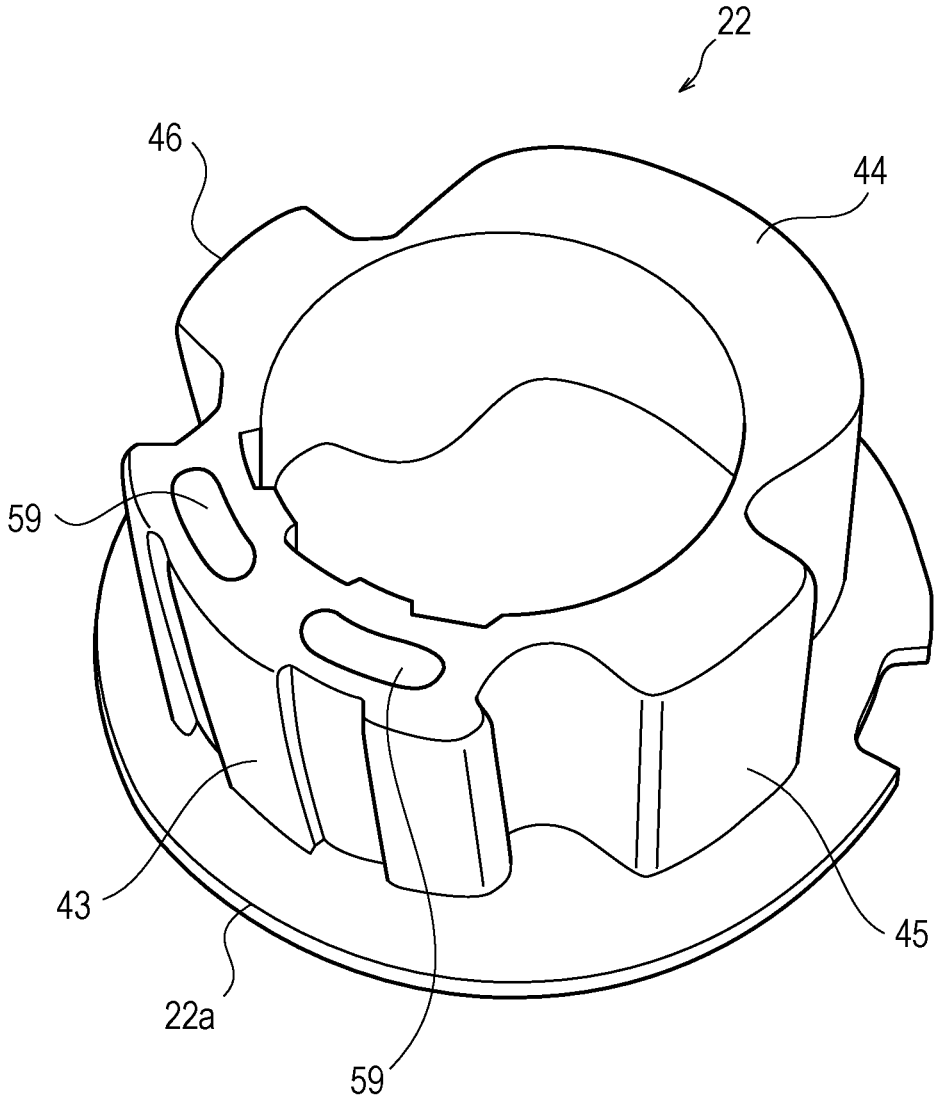
FIG. 6 is a perspective view viewing the mount member of the mounting device according to the embodiment of the present invention from a lower surface.

FIG. 6 is a perspective view viewing the mount 22 from the lower surface. FIG. 6 illustrates a free state of the mount 22. As illustrated in FIG. 5, the mount 22 is mounted appropriately compressed between the handle bracket 21 and the drive shaft housing 23 at the upper mount portion.

The mount 22 has a flange 22*a* with predetermined thickness at the upper portion. This flange shape allows setting the spring constant according to the need with respect to own weight of the outboard motor 10 and the load in a top-bottom direction with the thickness and the shape of this part, thus having vibration damping and displacement regulating functions.

In FIG. 5, the mount 22 includes a thrust transmitting portion 52 for forward movement at the rear protrusion 44 and includes a thrust transmitting portion 53 for rearward movement at the protrusion 43 on the front. The mount 22 includes steering force transmission portions 54 at the left and right protrusions 45 and 46. In this example, the mount 22 configures the steering central axis 50 at the cross-shaped intersection portion. Although FIG. 5 clearly illustrates only the steering force transmission portion 54 area on the right, the steering force transmission portion 54 is also configured similarly on the left side.

In the steering force transmission portion 54, a clearance 55 is configured between the inner peripheral surface of the handle bracket 21 and the mount 22. In this case, displacement restricting portions 56 (right-left direction) that restrict a displacement caused by a lift during the steering are provided. The clearance 55 may have a structure disposed between the outer peripheral surface of the drive shaft housing 23 and the mount 22.

Especially, at a base side of the rear protrusion 44 of the mount 22, a vibration reducing portion 57 is provided. The vibration reducing portion 57 reduces or damps the vibrations, which are caused by the torque reaction force of the engine 11, around the vibration central axis 51. The inner peripheral surface of the handle bracket 21 is formed into a shape approximately similar to the mount 22.

In the above-described case, a contact portion where an inner surface of the mount 22 contacts an outer surface of the drive shaft housing 23 and a contact portion where the outer surface of the mount 22 contacts the inner surface of the handle bracket 21 have a cylindrical surface around the vibration central axis 51 or a shape similar to the cylindrical surface. This shape forms a structure by which the rotational vibration (displacement) around the vibration central axis 51 is less likely to be transmitted to the outer peripheral side (that is, the spring constant is small). On the other hand, the clearance 55 is configured at the site perpendicular to the cylindrical surface. Accordingly, the drive shaft housing 23 freely rotates, namely, vibrates within some extent of range.

Figure 7:
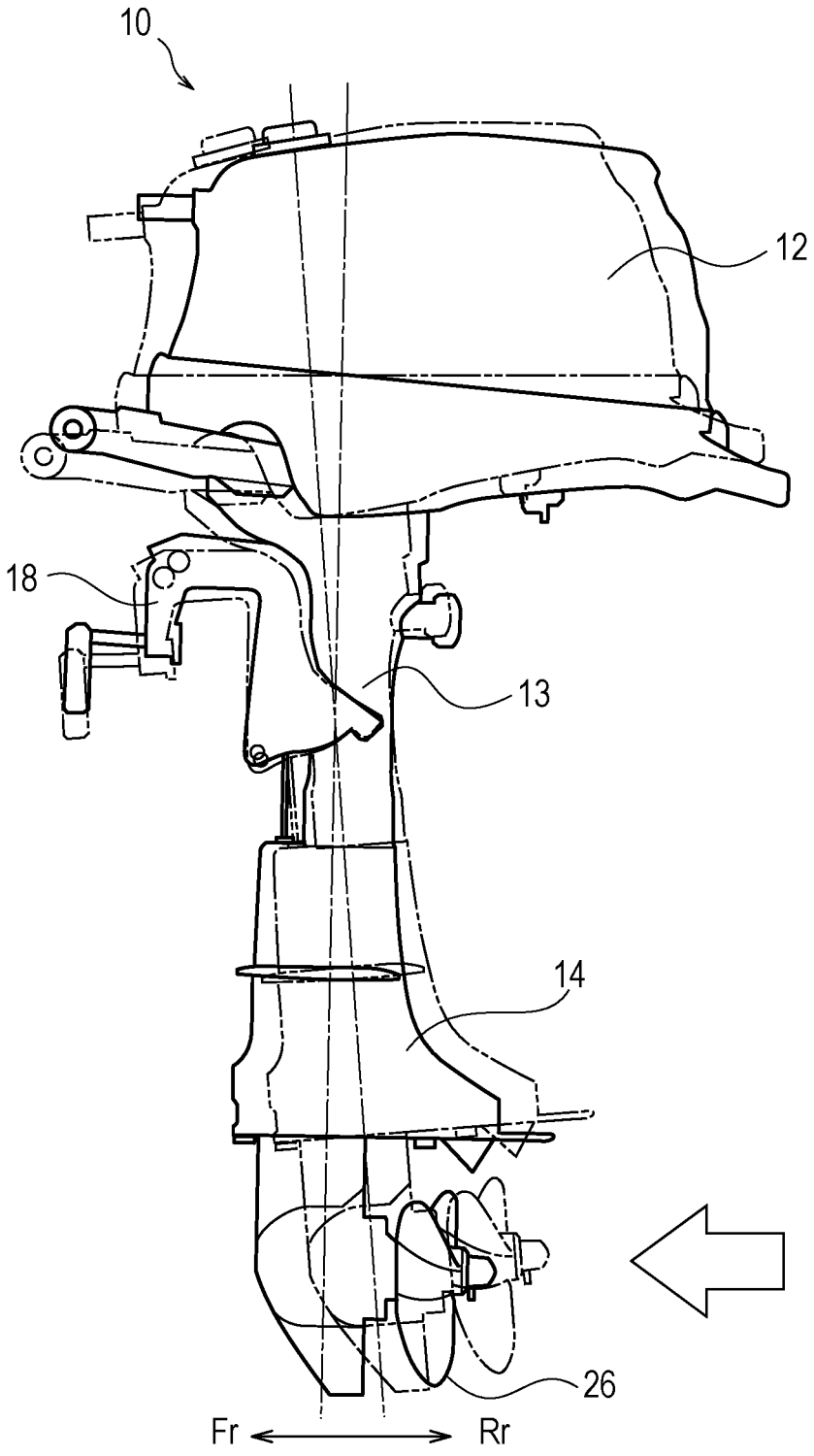
FIG. 7 is a drawing illustrating an example of a change in inclination in a front-rear direction when a thrust occurs in the outboard motor according to the embodiment of the present invention.

Further specifically describing the configuration of the mount 22 of the mounting device according to the present invention, the thrust transmitting portion 52 for forward movement prevents a rearward displacement of the drive shaft housing 23. The operation of the outboard motor 10 obtains propelling power through the rotation of the propeller 26. Meanwhile, as illustrated in FIG. 7, the outboard motor 10 itself is inclined rearward due to a reaction force from water and the drive shaft housing 23 attempts to perform the rearward displacement. In this case, the thrust transmitting portion 52 has the vibration damping function against a small load that displaces the drive shaft housing 23 rearward and a function against a large load that increases a contact area with the handle bracket 21 to transmit the propelling power.

In this case, the thrust generated at the propeller 26 inclines the outboard motor body portion supported by the upper and lower mounts 22A and 22B as illustrated in FIG. 7. In the outboard motor body, the mount 22A is displaced rearward while the mount 22B is displaced forward. The thrust increases in a high rotation area, and the rearward displacement of the drive shaft housing 23 compresses the thrust transmitting portion 52, thus increasing the spring constant. Simultaneous with this, clearances at both walls of the thrust transmitting portion 52 decrease, increasing the contact area. This improves responsiveness to the steering in the high rotation area, ensuring obtaining good steering feeling.

As illustrated in FIG. 5, a plurality of punching portions 58 are formed on the thrust transmitting portion 52 in alternation on the front and the rear. The thrust transmitting portion 52 has the vibration damping function where the shape gradually changes by the received load and the punching portions 58 are provided against the small load. Squashing the punching portions 58 increases the contact area with the handle bracket 21, thus ensuring receiving a large load. A deformation of the thrust transmitting portion 52 in the shear direction of the resilient body (such as rubber) can also obtain a smaller spring constant. For example, it is also possible to increase a volume of the mount 22 by the enlargement in the top-bottom direction (the vertical direction of the outboard motor 10) and in the diameter direction.

The thrust transmitting portion 53 for rearward movement prevents the drive shaft housing 23 from being displaced forward. During the rearward movement, opposite from the case of the forward movement, the outboard motor 10 is inclined forward and attempts to displace the drive shaft housing 23 forward. In this case, the thrust transmitting portion 53 has the vibration damping function against a small load that displaces the drive shaft housing 23 forward and a function against a large load that increases the contact area with the handle bracket 21 to transmit the propelling power. As illustrated in FIG. 5, a plurality of punching portions 59 are formed on the thrust transmitting portion 53 in alternation on the front and the rear.

Both the thrust transmitting portion 52 for forward movement and the thrust transmitting portion 53 for rearward movement are configured to have a small spring constant against the load around the vibration central axis 51.

Further, in FIG. 5, the steering force transmission portions 54 are sites that can transmit the steering force larger than that of the vibration reducing portions 57. For a large steering force, since the vibration reducing portions 57 are not disposed at positions opposed to the circle or the arc around the steering central axis 50, with the flexible mount 22 (that is, the rubber hardness is low), the vibration reducing portions 57 cannot transmit the large steering force by escaping the drive shaft housing 23 (the left side part) in the left direction in FIG. 5. In contrast to this, the steering force transmission portions 54 are positioned opposed to the circle or the arc around the steering central axis 50. The transmission of a compressive load of the mount 22 at a surface perpendicular to this steering central axis 50 allows the transmission of the large steering force.

Next, the vibration reducing portions 57 are sites configured to reduce the transmission of the vibrations (the rotational vibrations caused by the torque reaction force) generated by the reaction force of the driving torque from the engine 11. The burning of the engine 11 generates a torque variation, and the reaction force of the torque generates the vibrations in the rotation direction in the outboard motor body. The pressure variation generated by the burning of the engine 11 is transmitted to the crankshaft 15 via the piston 33, thus causing the torque variation. At this time, an engine block receives the torque reaction force and rotates (is displaced) around the shaft of the crankshaft 15. In this case, at the position (height direction) of the mount 22, the vibration central axis 51 of the vibrations caused by the reaction force of the torque does not match the steering central axis 50 of the outboard motor body and the steering handle, that is, is positioned appropriately shifted rearward.

The vibration reducing portions 57 have a function to transmit the steering force in addition to the vibration reduction function. The vibration reducing portions 57 are easily displaced around the vibration central axis 51 in FIG. 5. Regarding the rotation direction around the steering central axis 50, the force can be transmitted in the compression direction of the mount 22, which is the resilient member (for example, rubber). That is, the vibration reducing portions 57 are configured such that the steering force is easily transmitted and therefore the responsiveness of the steering and good operational feeling are easily obtained.

Figure 8A:
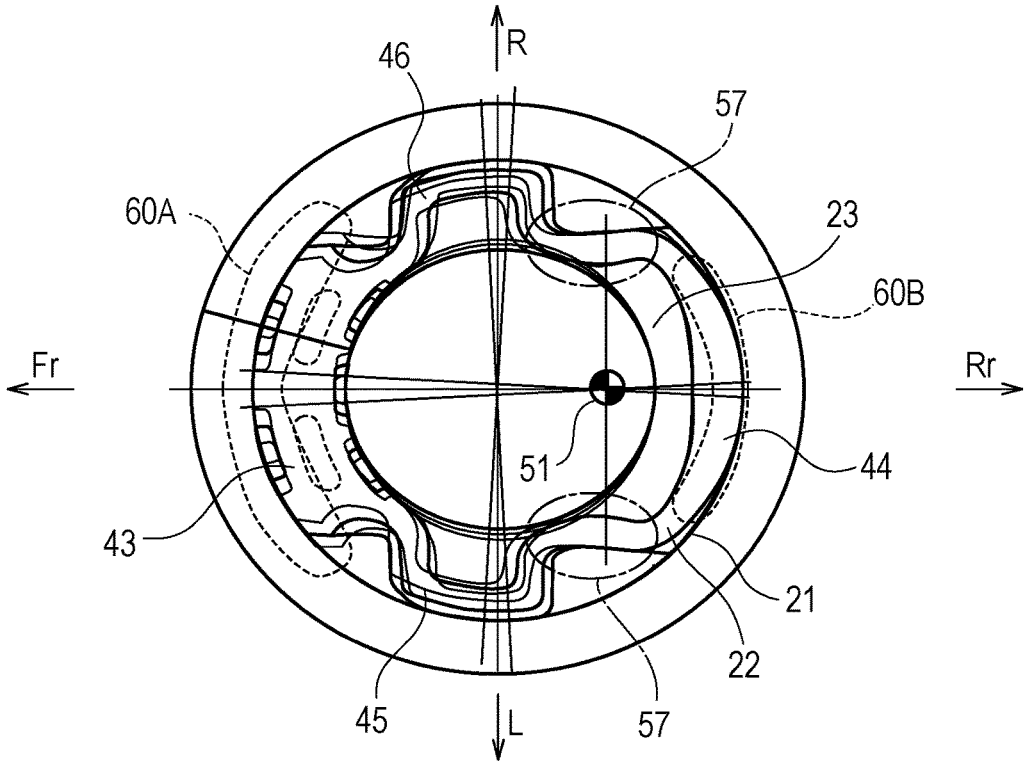
FIG. 8A is a drawing schematically illustrating a situation of rotational displacement of a drive shaft housing around a vibration central axis according to the embodiment of the present invention.

FIG. 8A is a drawing schematically illustrating a displacement condition in the case where the drive shaft housing 23 is rotated (±3 degrees) around the vibration central axis 51. In FIG. 8A, in addition to the vibration reducing portions 57, contact portions 60A and 60B are sites to make it hard to block (the spring constant is small) the rotation around the vibration central axis 51. That is, this allows a reduction in transmission of the rotational vibration by the torque reaction force. The clearances 55 are disposed at parts other than these members.

Figure 8B:
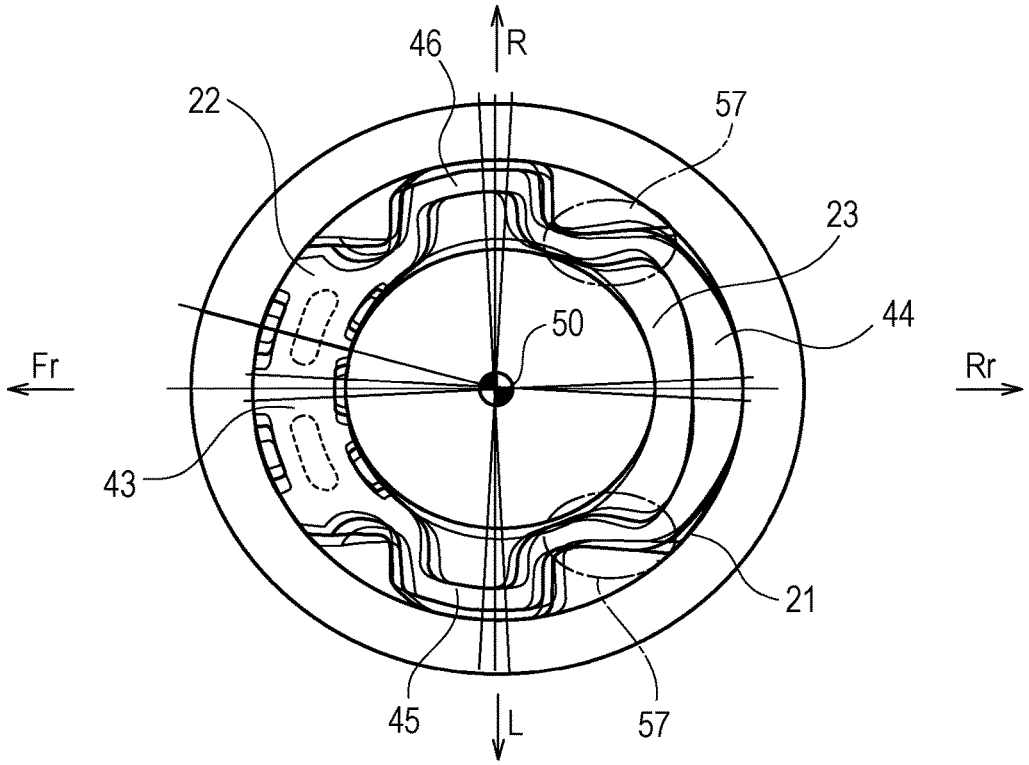
FIG. 8B is a drawing schematically illustrating a situation of the rotational displacement of the drive shaft housing around a steering central axis according to the embodiment of the present invention.

FIG. 8B is a drawing schematically illustrating the displacement condition in the case where the drive shaft housing 23 is rotated (±3 degrees) around the steering central axis 50. In this case, the vibration reducing portions 57 become sites that easily transmit the rotational displacement around the steering central axis 50.

In the above-described case, the outboard motor 10 has the structure that positions the cylinder block 29, the cylinder head 30, the cylinder head cover 31, the piston 33, and a similar member at the rear of the crankshaft 15. Therefore, a center of gravity of the outboard motor body (a part supported by the mount 22) is positioned rearward with respect to the crankshaft 15.

The following describes main operational advantages with the mounting device for outboard motor according to the present invention. First, the steering central axis 50 and the vibration central axis 51 are configured shifted back and forth. The spring constant for the vibration central axis 51 of the mount 22 is formed to be smaller than the spring constant for the steering central axis 50. Against the rotational vibration caused by the torque reaction force generated by the reaction force of the driving torque from the engine 11, the mount 22 is easily displaced around the vibration central axis 51 (namely, the spring constant is small), and the force is easily transmitted around the steering central axis 50 (the spring constant is large).

Thus, the setting by changing the magnitude of the spring constants for the steering central axis 50 and the vibration central axis 51 by the single mount 22 allows the accurate transmission of the steering load and the reduction in the transmission of the rotation vibration caused by the torque reaction force from the engine 11.

Figure 9:
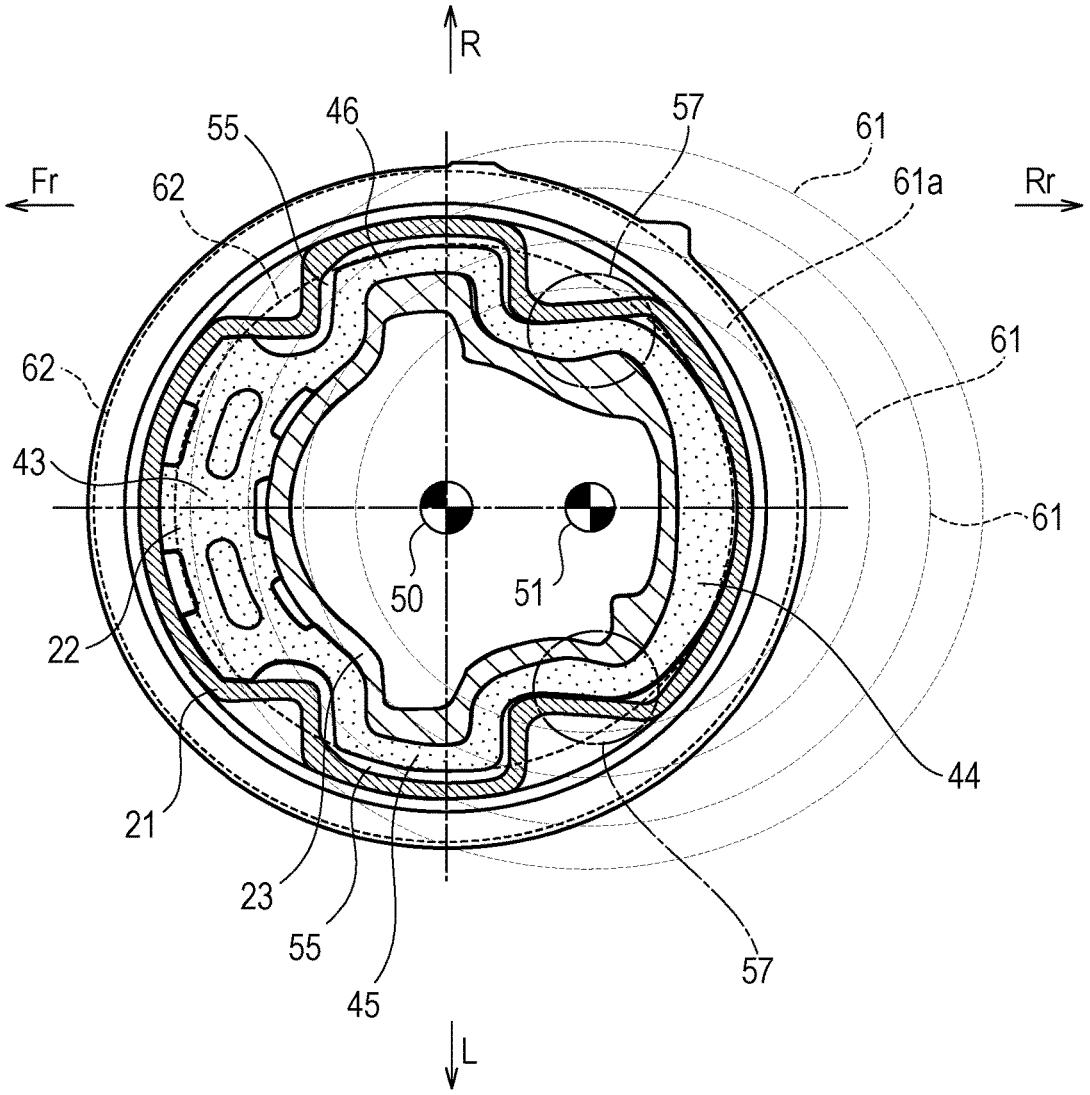
FIG. 9 is a schematic diagram illustrating a displacement state of mounts of the respective steering central axis and vibration central axis according to the embodiment of the present invention.

Specifically, as illustrated in FIG. 9, the vibration reducing portions 57 are configured so as to approximately go along the circle or the arc (a circle 61*a* among a plurality of concentric circles 61 shown by dotted line in FIG. 9) around the vibration central axis 51, thereby easing the displacement in this arc direction. The clearances 55 are configured at the parts where the displacement is less likely to occur, thus reducing the transmission of the rotational vibration by these members.

The steering force transmission portions 54 ease the transmission of the steering load in the direction of the circle or the arc (a plurality of concentric circles 62 shown by dotted lines in FIG. 9) around the steering central axis 50. The spring constant of the mount 22 is large in this direction perpendicular to the arc and is thin in the compression direction of the mount 22.

Thus, devising the shape of the mount 22 ensures obtaining the nonlinear spring constant with the identical member (rubber hardness). With the steering force transmission portions 54 and the vibration reducing portions 57, the nonlinear spring constant is obtained against the steering force. These other parts also ensure obtaining the nonlinear spring constant through the shear, compression, or a similar operation of the mount 22. This ensures forming the mount 22 with the easy molding structure (one-way molding structure) with the single member.

Since the mount 22 has a configuration falling within between the mutual components, a member such as a bolt and a bracket for the mounting is not required. Accordingly, the mount 22 is simple and lightweight, also excellent in compactification and attachability. Although being the single member, the mount 22 has many functions depending on the shape of each site. Designing the mount 22 so as to extend in the identical cross-sectional shape to the top and bottom (vertical direction) is also easy, ensuring the change (reduction) in surface pressure applied to the mount 22. Accordingly, changing the hardness (rubber hardness) of the mount 22 allows the appropriate adjustment for the required spring constant.

Further, disposing the clearances 55 between the respective right and left steering force transmission portions 54 and the inner peripheral surface of the handle bracket 21 does not interrupt the swing of the outboard motor 10 in the right-left direction, thus improving the vibration damping performance. The protrusion 43 on the front side of the mount 22 needs not to be excessively flexible. This avoids losing the steering feel of the tiller handle 20 during steering, that is, this avoids a limp steering feel.

Configuring the curvature radius r of the outer peripheral surface of the rear protrusion 44 of the mount 22 smaller than the curvature radius of the inner peripheral surface of the handle bracket 21 does not interrupt the turning near the vibration central axis 51 against the rotational vibration caused by the torque reaction force. Accordingly, the protrusion 43 on the front side needs not to be excessively flexible. This case also ensures obtaining the good steering feel while the steering feel of the tiller handle 20 during steering intact.

Further, configuring the radial thickness of the mount 22 thinner than the protrusion 43 on the front side of the mount 22 ensures appropriately changing the hardness of the mount 22 as necessary without changing the material (mechanical property). This improves productivity of the mount 22, ensuring achieving a cost reduction. The drive shaft housing 23 includes the protrusions 47, 48, and 49 to prevent a positional displacement of the mount 22, allowing securing and maintaining predetermined performance.

While the present invention has been described with the above-described various embodiments, the present invention is not limited only to these embodiments. Changes and similar modification are possible within the scope of the present invention.

For example, although the embodiment describes the example of the OHV engine as the engine 11, the engine 11 may be another form, for example, an OHC engine.

With the present invention, the setting by changing the magnitude of the spring constant for the steering central axis and the vibration central axis by the single mount member allows the accurate transmission of the steering load and the reduction in the transmission of the rotation vibration caused by the torque reaction force from the engine. Additionally, the present invention features the simple configuration and lightweight, also excellent in compactification and attachability.

What is claimed is:

1. A mounting device for an outboard motor comprising:

an engine comprising a crankshaft in a vertical direction and a cylinder axis line extending rearward in a ship advancing direction;

a drive shaft housing that internally comprises a drive shaft longitudinally-oriented, the drive shaft being coupled to the crankshaft at a lower side of the engine; and a swivel bracket that rotatably supports a tubular outer peripheral portion of the drive shaft housing by an upper mount portion and a lower mount portion, wherein:

a mount member is fitted to at least the upper mount portion, the mount member being formed of a resilient body and rotates integrally with the tubular outer peripheral portion of the drive shaft housing, a handle bracket is fitted onto an outer periphery of the mount member, the handle bracket supporting a steering handle, the steering handle being turnable with respect to the upper mount portion, and in the upper mount portion, a steering central axis for a steering force of the steering handle and a vibration central axis for a torque reaction force of the engine are configured to be shifted back and forth, and the mount member is formed such that a spring constant for the vibration central axis is smaller than a spring constant for the steering central axis.

2. The mounting device for outboard motor according to claim 1, wherein:

the mount member forms an approximately cross-shaped steering force transmission portion comprising a front protrusion, a rear protrusion, a right protrusion and a left protrusion to form an inner peripheral surface of the handle bracket into a shape approximately similar to the mount member, the right protrusion and the left protrusion comprise a shape approximately similar to the mount member being formed on an outer peripheral surface of the drive shaft housing, and the mount member is configured to have the steering central axis at a cross-shaped intersection portion.

3. The mounting device for outboard motor according to claim 2, wherein clearances are disposed between the right protrusion and the left protrusion of the mount member and the inner peripheral surface of the handle bracket or the outer peripheral surface of the drive shaft housing.

4. The mounting device for outboard motor according to claim 2, wherein a curvature radius of an outer peripheral surface of the rear protrusion of the mount member is configured smaller than a curvature radius of the inner peripheral surface of the handle bracket.

5. The mounting device for outboard motor according to claim 3, wherein a curvature radius of an outer peripheral surface of the rear protrusion of the mount member is configured smaller than a curvature radius of the inner peripheral surface of the handle bracket.

6. The mounting device for outboard motor according to claim 2, further comprising:

protrusions that project from the drive shaft housing outside at an inside of the rear protrusion, the right protrusion and the left protrusion of the mount member, wherein the protrusions are configured to have radial thicknesses of the rear protrusion, the right protrusion and the left protrusion of the mount member thinner than a radial thickness of the front protrusion of the mount member.

7. The mounting device for outboard motor according to claim 3, further comprising:

protrusions that project from the drive shaft housing outside at an inside of the rear protrusion, the right protrusion and the left protrusion of the mount member, wherein the protrusions are configured to have radial thicknesses of the rear protrusion, the right protrusion and the left protrusion of the mount member thinner than a radial thickness of the front protrusion of the mount member.

8. The mounting device for outboard motor according to claim 4, further comprising:

protrusions that project from the drive shaft housing outside at an inside of the rear protrusion, the right protrusion and the left protrusion of the mount member, wherein the protrusions are configured to have radial thicknesses of the rear protrusion, the right protrusion and the left protrusion of the mount member thinner than a radial thickness of the front protrusion of the mount member.

9. The mounting device for outboard motor according to claim 5, further comprising:

protrusions that project from the drive shaft housing outside at an inside of the rear protrusion, the right protrusion and the left protrusion of the mount member, wherein the protrusions are configured to have radial thicknesses of the rear protrusion, the right protrusion and the left protrusion of the mount member thinner than a radial thickness of the front protrusion of the mount member.

* * * * *